US005582081A

United States Patent [19]

Lin

[11] Patent Number: 5,582,081

[45] Date of Patent: Dec. 10, 1996

[54] REVERSIBLE SCREWDRIVER

[76] Inventor: Ching-Chou Lin, No. 150, Sec. 3, Chung Shan Road, Wu Jin Hsiang, Taichung Hsien, Taiwan

[21] Appl. No.: 512,917

[22] Filed: Aug. 9, 1995

Related U.S. Application Data

[63] Continuation-in-part of Ser. No. 294,501, Aug. 23, 1994, abandoned.

[51] Int. Cl.[6] ..... B25B 13/46

[52] U.S. Cl. ..... 81/63.1

[58] Field of Search ..... 81/63.1, 58.4, 81/60–62, 63.2; 192/43.2

[56] References Cited

U.S. PATENT DOCUMENTS

| | | | |
|---|---|---|---|
| 3,290,969 | 12/1966 | Bergquist et al. | 81/63.1 |
| 4,770,071 | 9/1988 | Steier | 81/60 X |
| 4,777,852 | 10/1988 | Herman et al. | 81/63.1 |
| 4,901,607 | 2/1990 | Beugelsdyk et al. | 192/43.2 X |
| 5,063,797 | 11/1991 | Huang | 81/60 |

*Primary Examiner*—D. S. Meislin
*Attorney, Agent, or Firm*—Bacon & Thomas

[57] ABSTRACT

A screwdriver including a handle, a driving block fastened to the handle at one end, a front cap enclosing and rotatably fastened to the driving block, and a transmission shaft having a ratchet wheel at one inserted into a hole on the driving block and a square tip at an opposite end extended out of the front cap for turning screws, and two stop blocks controlled by rotation of the front cap to simultaneously or alternatively engage the ratchet wheel thus permitting the transmission shaft to be turned by the driving block in both clockwise and counter-clockwise direction, or permitting it to be turned in only a clockwise or counter-clockwise direction.

5 Claims, 3 Drawing Sheets

REVERSIBLE SCREWDRIVER

CROSS-REFERENCE TO RELATED APPLICATION

The present invention is a continuation-in-part of patent application Ser. No. 08/294,501, filed on Aug. 23, 1994, now abandoned.

BACKGROUND OF THE INVENTION

The present invention relates to screwdrivers, and relates more particularly to such a screwdriver which can be alternatively set at either mode to turn screws clockwise/counter-clockwise, clockwise only, or counter-clockwise only.

Various screwdrivers have been disclosed, and have appeared on the market e.g. the hand-held tool as shown in the U.S. Pat. No. 5,063,797, the ratcheting tool driver as shown in the U.S. Pat. No. 4,901,607 and the ratcheting screwdriver as shown in the U.S. Pat. No. 4,777,852. Among conventional screwdrivers, reversible screwdrivers are most popularly accepted for the advantage of being reversible. However, a reversible screwdriver can only be driven to turn screws in one direction, i.e. it runs idle when turned in reverse direction.

SUMMARY OF THE INVENTION

The present invention has been handle 1 is turned in the reversed direction accomplished to provide a screwdriver which can be alternatively set at either mode to turn screws clockwise/counter-clockwise, clockwise only, or counter-clockwise only. According to the preferred embodiment of the present invention, the screwdriver comprises a handle, a driving block fastened to the handle at one end, a front cap fastened to the handle and covered around the driving block, and a transmission shaft having a ratchet wheel at one and inserted into a hole on the driving block and a square tip at an opposite end extended out of the front cap for turning screws, and two stop blocks received in a side slot on the driving block and pressed by a plano-convex elastic presser block and controlled by the front cap to simultaneously or alternatively engage the ratchet wheel. When both stop blocks are engaged with the ratchet wheel, the transmission shaft is prohibited from rotary motion relative to the driving block, i.e., turning the handle in either direction causes the transmission shaft to be turned synchronously. When only one stop block is engaged with the ratchet wheel, the transmission shaft can only be turned by the driving shaft clockwise or counter-clockwise.

DETAILED DESCRIPTION OF THE PREFERRED EMBODIMENT

Figure 1:
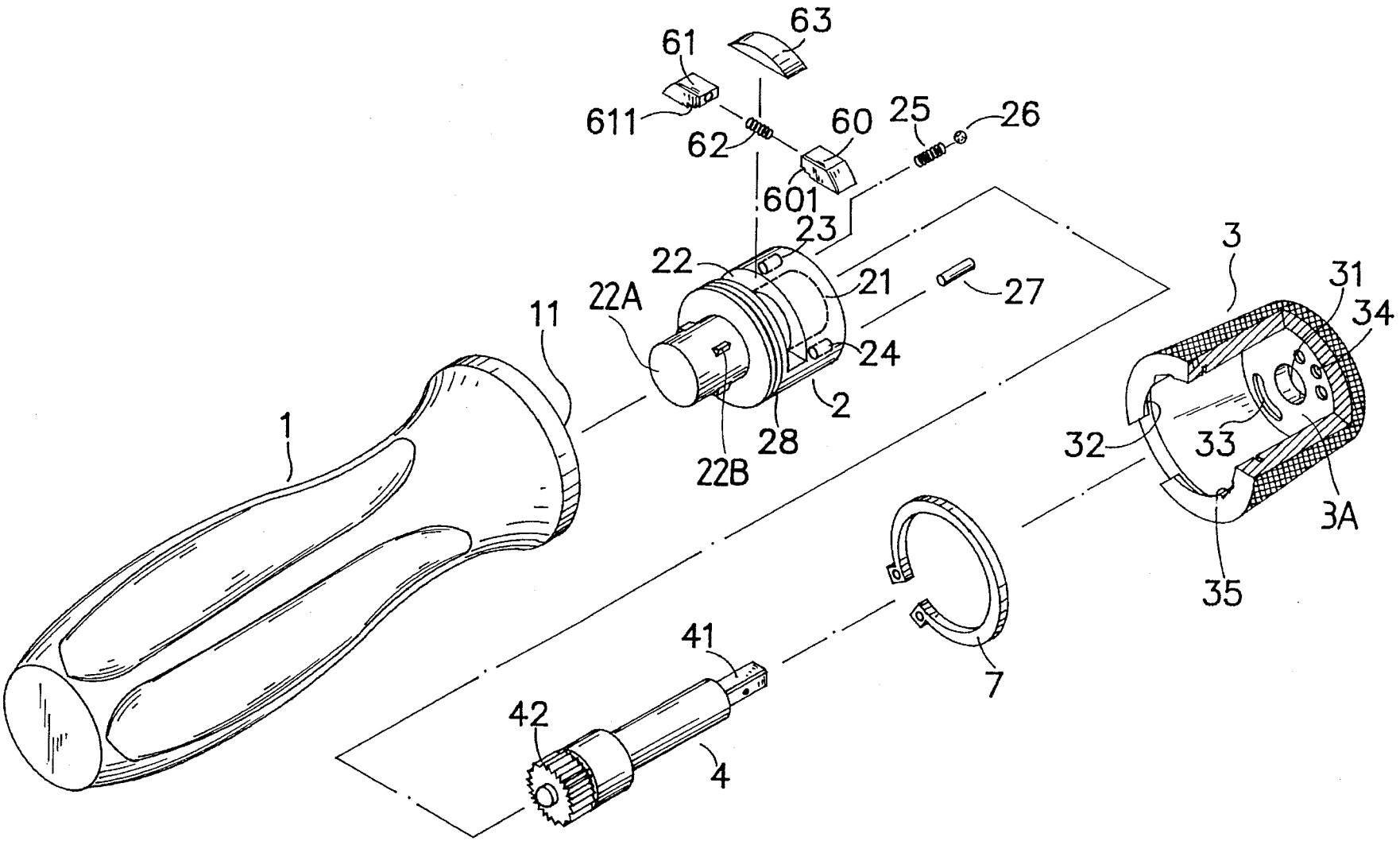
FIG. 1 is an exploded perspective view of a screwdriver according to the present invention.

Referring to FIG. 1, a screwdriver in accordance with the present invention is generally comprised of a handle 1, a driving block 2, a front cap 3, and a transmission shaft 4. The handle 1 has a mounting hole 11 on the front end thereof. The driving block 22 is shaped like a stepped cylinder that is defined in part by a reduced diameter stub shaft 22A provided with a plurality of outwardly extending tenons 22B circumferentally spaced around its outer surface. Shaft 22A received in mounting hole 11 and rigidly secured to handle 1 against rotation in any manner well known in the art for tools of this nature. For example, handle 1 may be injection molded around shaft 22A and tenons 22B or an appropriate adhesive may be utilized. Block 2 also includes a circular front hole 21 on the front end thereof at the center, a side slot 22 perpendicularly communicated with the recessed round hole 21, a recessed hole 23 and a pin hole 24 symmetrically disposed on the front end at two opposite sides by the circular front hole 21, and an outside annular groove 28 around the periphery. There is a spring 25 received in the recessed hole 23 of the driving block 2 to support a steel ball 26. There is a pin 27 inserted into the pin hole 24 of the driving block 2. The front cap 3 is of a hollow substantially cylinderical configuration has a center through hole 31 formed in a front end wall 3A thereof at the center, an arcuate groove 33 and a series of spaced locating recesses 34 symmetrically disposed on the inside of front end wall 3A adjacent the center through hole 31, an inside annular groove 32 around the inside wall near the open rear end thereof, and two opposite sharp recessed holes 35 on the inside wall near the inside annular groove 32. The transmission shaft 4 is a stepped cylinder having a square tip 41 at one end and a ratchet wheel 42 at an opposite end.

Figure 2:
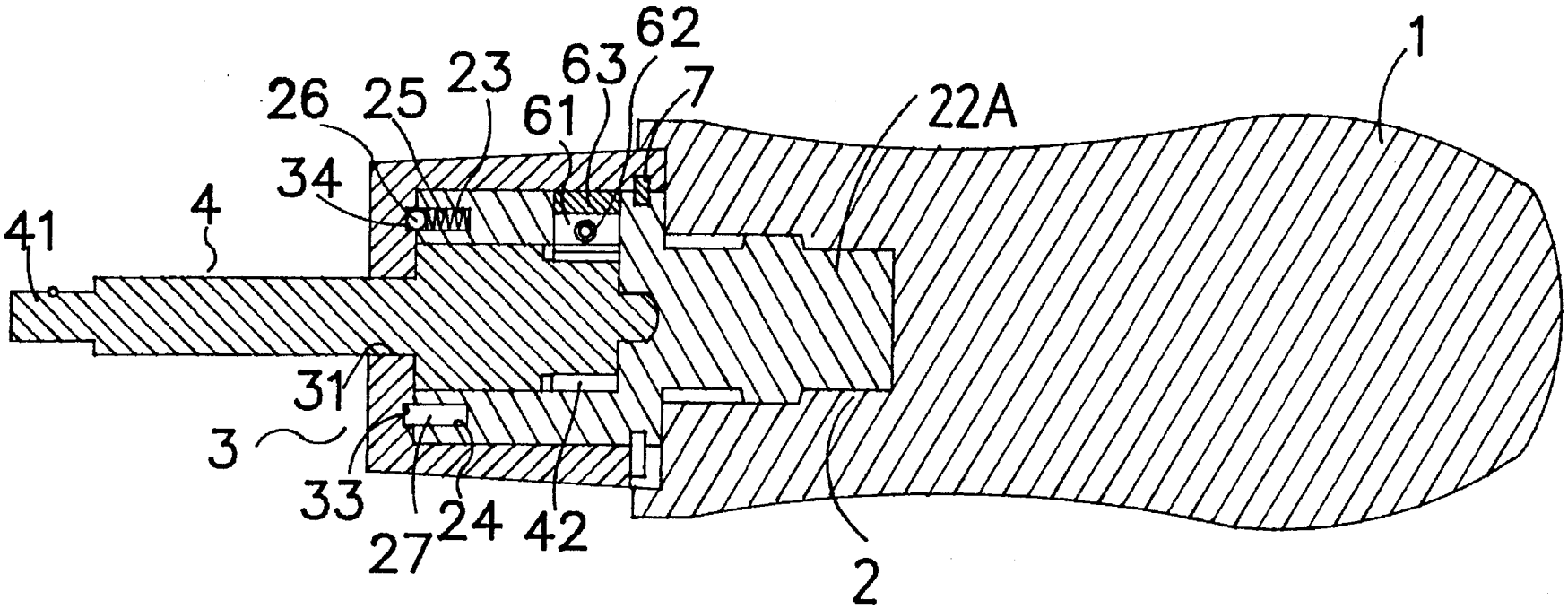
FIG. 2 is a longitudinal view in section of the screwdriver shown in FIG. 1.

The assembly process of the screwdriver is outlined hereinafter with reference to FIGS. 1 and 2. The driving block 2 is first inserted into the mounting hole 11, then the transmission shaft 4 is inserted into the recessed round hole 21 of the driving block 2 permitting the square tip 41 to be disposed outside the driving block 2, then a first stop block 60 and a second stop block 61, which are connected by a spring 62 and have a respective toothed portion 601 or 611 at the bottom, are respectively inserted into the side slot 22 of the driving block 2, then a plano-convex elastic presser block 63 is inserted into the side slot 22 and pressed on the stop blocks 60 and 61 causing the toothed portions 601 and 611 of the stop blocks 60 and 61 meshed with the ratchet wheel 42, then a clamp 7 is mounted on the inside annular groove 32 of the front cap 3 and then the front cap 3 is covered on the driving block 2 permitting the clamp 7 to be fastened to the outside annular groove 28 of the driving block 2. When assembled, the square tip 41 of the transmission shaft 4 extends out of the front cap 3 through the center through hole 31, the opposite end of the pin 27 is inserted into the arched groove 33, and the steel ball 26 is forced into one of the plural locating recesses 34.

Figure 3A:
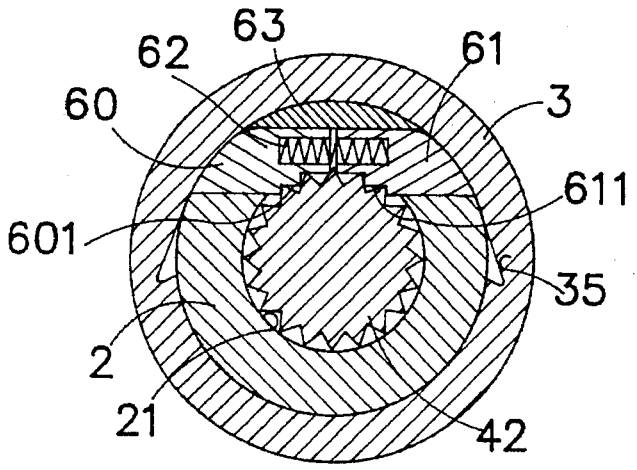
FIG. 3A is a cross section of the screwdriver shown in FIG. 2, showing the screwdriver set at the fixed mode.
Figure 3B:
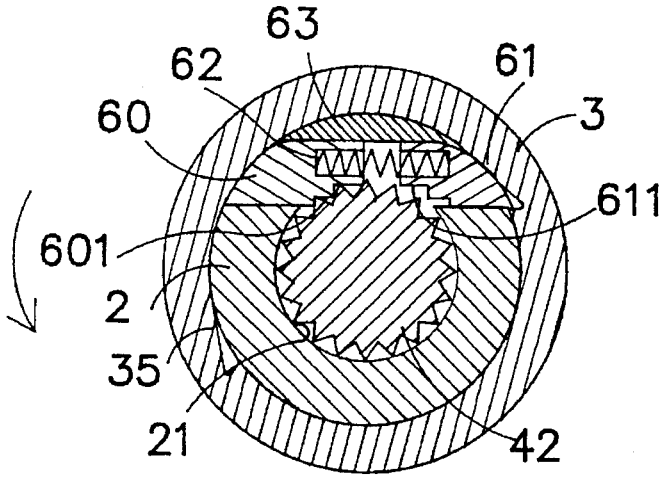
FIG. 3B is similar to FIG. 3A but showing the screwdriver set at the counter-clockwise rotation mode.
Figure 3C:
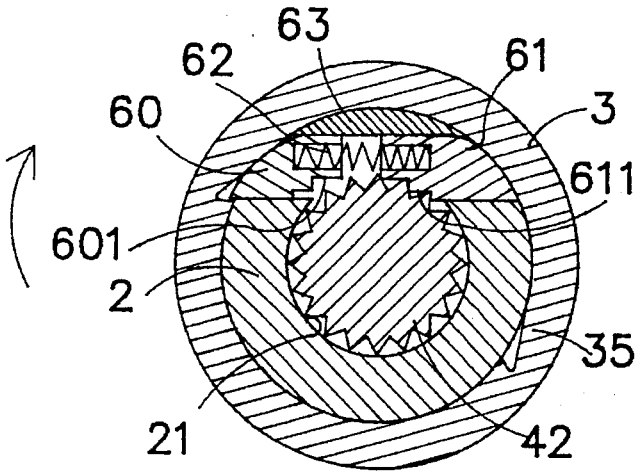
FIG. 3C is similar to FIG. 3A but showing the screwdriver set at the clockwise rotation mode.

Referring to FIGS. 3A, 3B, and 3C, the screwdriver can be set at either of three modes, namely, the fixed mode, the clockwise rotation mode, and the counter-clockwise rotation mode. When the front cap 3 is rotated relative to the driving block 2 permitting the steel ball 26 to engage the middle locating recess 34 (there are three locating recesses 34 on the front cap 3), the screwdriver is set at the fixed mode (see FIG. 3A) and, the elastic presser block 63 is forced by the inside wall of the front cap 3 to press the stop blocks 60 and 61, causing the toothed portions 601 and 611 meshed with the ratchet wheel 42, and therefore the transmission shaft 4 is prohibited from being moved relative to the driving block 2, so the screwdriver can be used by roatating the handle 1 either clockwise or counter-clockwise. When the front cap 3 is rotated in the direction indicated by the arrow in FIG. 3B relative to the driving block 2 permitting the steel ball 26 to engage the left-sided locating recess 34 on the front cap 3, the screwdriver is set at the counter-clockwise mode (see FIG. 3B). When the screwdriver is set at the counter-clockwise rotation mode, the second stop block 61 is pushed by the spring 62 into one recessed hole 35 in order to disengage from the ratchet wheel 42, so turning the handle 1 counter-clockwise causes the driving block 2 to turn the transmission shaft 4 also counter-clockwise by means of the engagement of first stop block 60 and the ratchet wheel 42, however when turning the handle 1 clockwise, the first stop block 60 is being pushed by the driving block 2 toward the elastic presser block 63, causing the first stop block 60 also disengaged from the ratchet wheel 42, so that the screwdriver is turned idle in clockwise direction because the ratchet wheel 42 has no engagement with either stop block. When the screwdriver is set at the clockwise rotation mode, the cap 3 is rotated in the direction indicated by the arrow in FIG. 3C, thereby causing the second stop block 61 to be removed from recess 35 and forced by the elastic presser block 63 to engage with the ratchet wheel 42, while the first stop block 60 is pushed by the spring 62 into the other recessed hole 35 in order to disengage from the ratchet wheel 42, and therefore turning the handle 1 clockwise causes the driving block 2 to turn the transmission shaft 4 also clockwise by means of the engagement of the ratchet wheel 42 and the stop block 61, however when turning the handle 1 counter-clockwise, the second stop block 61 is being pushed by the driving block 2 toward the elastic presser block 63, causing the stop block 61 also disengaged from the ratchet wheel 42, so that the screwdriver is turned idle in counter-clockwise direction because the ratchet wheel 42 has no engagement with either stop block.

I claim:

1. A reversible screwdriver comprising:

a) a handle including a front end;

b) a driving block secured to the front end of the handle, the driving block inncluding a recessed round hole, and a side slot intersecting with the recessed round hole, c) a hollow substantially cylindrical front cap including a front end wall, a side wall, a center hole formed in the front end wall, a first recess and a second recess provided at opposite sides of an internal portion of the sidewall, and the front cap enclosing and rotatably fastened to the driving block;

d) a transmission shaft including a ratchet wheel disposed within the recess round hole of the driving block and a square tip extending outwardly through the center hole of the front cap;

e) a first stop block and a second stop block disposed within the side slot of the driving block, for selective engagement with the ratchet wheel and the first and second recesses of the front cap upon rotation of the cap in the clockwise and counter-clockwise directions; and f) wherein the front cap may be rotated to a first position disposing both the first and second stop blocks into engagement with the ratchet wheel to permit the transmission shaft to be turned by the handle in either a clockwise or a counter-clockwise direction, a second position wherein the first stop block is disposed within the first recess and the second stop block is disposed in engagement with the ratchet wheel to permit the handle to turn the transmission shaft in only the clockwise direction, a third position wherein the second stop block is disposed within the second recess and the first stop block disposed in engagement with the ratchet wheel to permit the handle to turn the transmission shaft only the counter-clockwise position.

2. The reversible screwdriver of claim 1 wherein:

a) the front cap further includes an arcuate groove and three-spaced recesses formed in an internal side of the front end wall on opposite sides of the center hole; and b) the driving block includes a front pin movably engaged within the arcuate groove, a front recess hole, a spring-biases steel ball disposed within the front recess hole for selective engagement within either of the recesses to secure the front cap in either of the first, second, or third positions.

3. The reversible screwdriver of claim 1 wherein:

a) the driving block includes an outside annular groove;

b) the front cap includes an inside annular groove; and c) the front cap is fastened to the driving block by a clamp engaged within the inside and outside annular grooves.

4. The reversible screwdriver of claim 1 wherein each of the first and second stop blocks are provided with a flat top and a spring means connecting the stop blocks side by side.

5. The reversible screwdriver of claim 1 further including a elastic presser block disposed in the side slot of the driving block and urged by the front cap against either one or both of the first and second stop blocks and same to simultaneously or alternately engage with the ratchet wheel, the elastic presser block having a convex top for engagement by the front cap and a flat bottom, for engagement against the stop blocks.

* * * * *